US010018200B2

(12) United States Patent
Del Rio

(10) Patent No.: US 10,018,200 B2
(45) Date of Patent: Jul. 10, 2018

(54) SELF-CONTAINED COLD PLATE FOR COOLING ELECTRONIC COMPONENTS OF AN ELECTRIC FAN

(71) Applicant: TECHNOFAN, Blagnac (FR)

(72) Inventor: Fabien Del Rio, Segoufielle (FR)

(73) Assignee: TECHNOFAN, Blagnac (FR)

( * ) Notice: Subject to any disclaimer, the term of this patent is extended or adjusted under 35 U.S.C. 154(b) by 218 days.

(21) Appl. No.: 14/592,063

(22) Filed: Jan. 8, 2015

(65) Prior Publication Data

US 2015/0192137 A1 Jul. 9, 2015

(30) Foreign Application Priority Data

Jan. 9, 2014 (FR) ..... 14 50143

(51) Int. Cl.

| | |
|---|---|
| ***F04D 19/00*** | (2006.01) |
| ***F04D 25/08*** | (2006.01) |
| ***F04D 29/58*** | (2006.01) |
| ***F04D 25/06*** | (2006.01) |

(52) U.S. Cl.

CPC ..... *F04D 19/00* (2013.01); *F04D 25/068* (2013.01); *F04D 25/082* (2013.01); *F04D 29/5813* (2013.01)

(58) Field of Classification Search

CPC ..... F04D 25/082; F04D 29/5813
USPC ..... 417/366, 369, 370
See application file for complete search history.

(56) References Cited

U.S. PATENT DOCUMENTS 2,397,171 A 3/1946 Troller et al.
2,469,820 A 5/1949 Fuge
3,229,896 A 1/1966 Levy
7,295,434 B2 * 11/2007 Foulonneau ..... F04D 29/584 361/691
2012/0236498 A1 9/2012 Pal et al.

FOREIGN PATENT DOCUMENTS

| | | |
|---|---|---|
| EP | 2 186 704 A1 | 5/2010 |
| GB | 1 130 700 A | 10/1968 |
| WO | 2008/109038 A2 | 9/2008 |

OTHER PUBLICATIONS

FR Search Report, dated Oct. 6, 2014, from corresponding FR application.

* cited by examiner

*Primary Examiner* — Patrick Hamo
(74) *Attorney, Agent, or Firm* — Young & Thompson

(57) ABSTRACT

A fan (10) includes:

an external ferrule (12), whose internal surface (20) delimits a vein of air (14), a wheel (26) provided with blades (28) rotatably mounted in the ferrule (12) for setting into motion the vein of air, a motor (22) for driving the wheel (26), an electric circuit (40) including components (44) for controlling and powering the motor (22), which circuit (40) includes elements for cooling the components (44) by circulating air taken from the vein of air (14), wherein the cooling elements include a downstream area intake tapping aperture (52) and an upstream tapping aperture (54, 56) for reintroducing air formed through the internal surface (20) of the ferrule (12), and at least one continuous cooling conduit (50) connecting the upstream and downstream tapping apertures isolating the components (44) of the electric circuit from the air circulating in the cooling conduit.

11 Claims, 2 Drawing Sheets

SELF-CONTAINED COLD PLATE FOR COOLING ELECTRONIC COMPONENTS OF AN ELECTRIC FAN

The present invention relates to a fan of the type including:

- an external ferrule, the internal surface of which delimits a vein of air,
- a wheel provided with blades rotatably mounted in the ferrule for setting into motion the vein of air,
- a motor for driving the wheel, and
- an electric circuit including components for controlling and powering the motor, which circuits includes means for cooling the components by circulating air taken in the vein of air.

Many fans are used in airplanes for ensuring air-conditioning of the cabin of the aircraft, or further for ensuring cooling of pieces of equipment of the aircraft.

These fans are powered by the electric network of the airplane. In order to ensure control and powering of the motor of the fan, the fan is equipped with an electric control circuit which, by its operation, produces heat.

For removing heat, it is known how to position electronic components of the electric circuit on a radiator which protrudes inside the vein of air delimited by the external ferrule of the fan. Such a layout degrades the aeraulic performances of the fan.

Document US 2012/0236498 describes a fan comprising means for cooling the electric circuit formed by a tapping aperture opening into the vein of air of the fan and able to take up a secondary cooling flow which circulates between the electronic components of the circuit in order to ensure their cooling.

This layout, even if it gives the possibility of not reducing the aeraulic yield of the fan by the presence of a radiator in the vein of air, is of limited efficiency, the cooling flow rate around the components being low and the layouts may lead to the transmission of contaminating elements towards the components from the vein of air of the fan.

The object of the invention is to propose a fan, notably for aircraft, in which the cooling of the electric control circuit is efficient, without reducing the aeraulic yield of the fan.

For this purpose, the object of the invention is a fan of the aforementioned type, characterized in that:

- said cooling means include an air intake downstream tapping aperture and an upstream tapping aperture for reintroducing air formed through the internal surface of the ferrule, and
- at least one continuous cooling conduit connecting the upstream and downstream tapping apertures isolating the components of the electric circuit from the air circulating in the cooling conduit.

According to particular embodiments, the fan includes one or several of the following features:

- said or each cooling conduit extends in the thickness of the external ferrule and the electronic circuit components are in thermal contact with the external surface of the ferrule;
- the ferrule is generally cylindrical and the cooling conduits generally extend along a generatrix of the ferrule;
- each cooling conduit includes a main segment extending longitudinally in the thickness of the ferrule from the upstream tapping aperture to the downstream tapping aperture, this main segment being buffered at each end, and in that the cooling conduit includes two generally radical perforations connecting the upstream tapping aperture and the downstream tapping aperture of the main segment;
- the current diameter of said or each cooling conduit is comprised between 4 and 8 mm;
- said or each cooling conduit is able to take up 0.5% to 5% of the total flow rate of the fan;
- said or each cooling conduit is dimensioned so that the circulation rate of the cooling flow is at least equal to 10 $m \cdot s^{-1}$, and preferably at least equal to 30 $m \cdot s^{-1}$.

The invention will be better understood upon reading the description which follows, only given as an example and made with reference to the drawings wherein.

Figure 1:
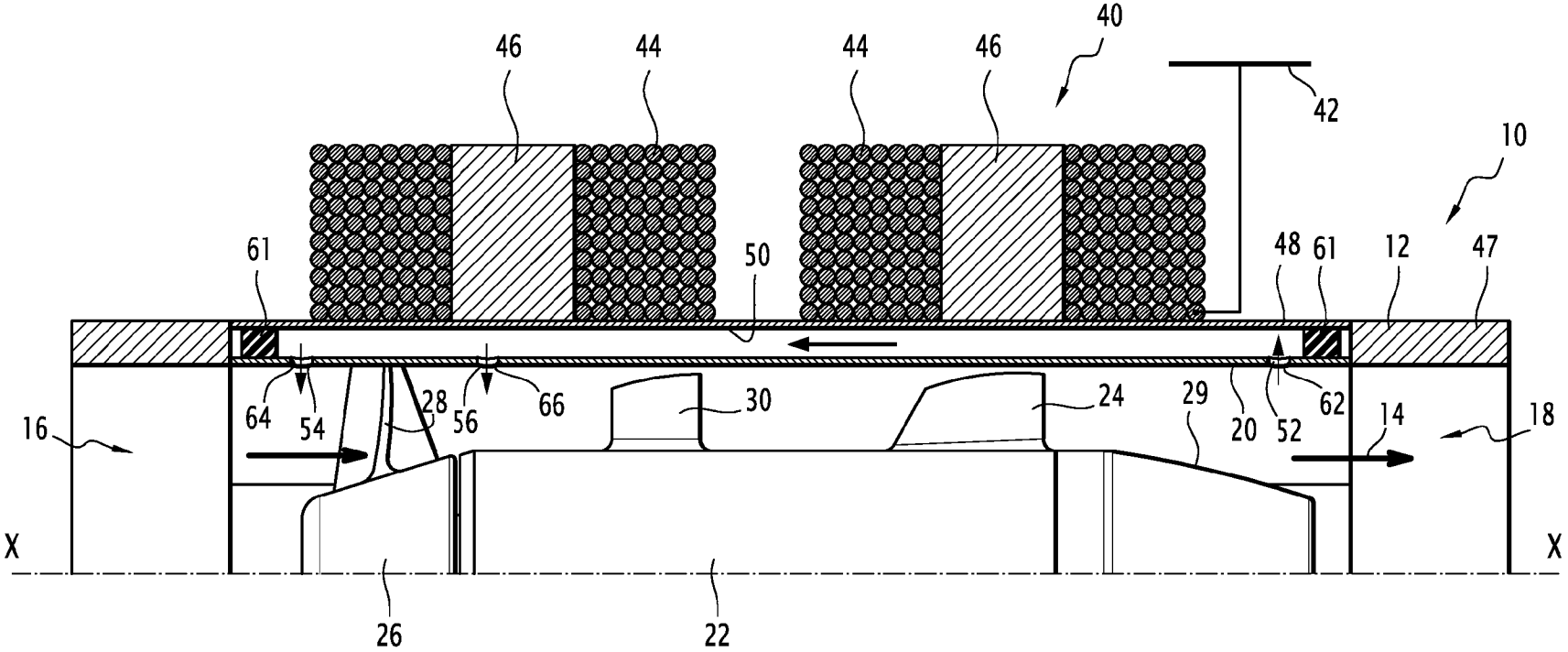
FIG. 1 is a sectional view of a fan according to the invention.

The fan 10 illustrated in FIG. 1 is a fan for an airplane or a helicopter. It is able to be installed on an air-conditioning circuit for the cabin in order to ensure the setting into motion of an air flow. Its flow rate is comprised between 50 $l \cdot s^{-1}$ and 1,500 $l \cdot s^{-1}$, and notably between 100 $l \cdot s^{-1}$ and 750 $l \cdot s^{-1}$, for example 470 $l \cdot s^{-1}$ It includes an external ferrule 12 delimiting a vein of air 14, circulating from an inlet 16 of the fan to as far as an outlet 18.

The ferrule 12 has an internal surface 20 delimiting the vein of air. This surface is cylindrical with a circular section with a general axis X-X forming the fan axis.

As known per se, a motor 22 is provided along the X-X axis. This motor is borne by supporting arms 24 connecting the stator of the motor to the ferrule 12. A wheel 26 provided with blades 28 is mounted on the rotor of the motor on the air intake 16 side. A nose cone 29 extends the motor 22 opposite to the wheel 26.

A crowd of fins 30 forming an air rectifier extends around the motor 22 downstream from the blades 28 of the wheel. The vein of air 24 produced by rotation of the wheel 26 is circulates between the internal surface 20 of the ferrule and the external surface of the motor 22 and of the nose cone 29.

The fan finally includes a circuit 40 four controlling and powering the motor 22. This circuit is connected to the power supply network 42 specific to the airplane at the inlet and to the motor 22 at the outlet.

The circuit 40 includes a set of electronic components such as coils 44 borne by cores 46 radially extending to the external surface of the ferrule 12. The components are attached on the external surface of the ferrule 12 in thermal contact with the latter.

In this embodiment, the ferrule 12 comprises generally cylindrical tubing 47 and a base 48 for supporting the circuit 40.

The tubing 47 includes an oblong lumen extending along a length of the corresponding tubing, substantially at right angles to the motor 22. The base 48 is received into this lumen and is sealably secured therein for the vein of air.

The surfaces of the tubing 47 and of the base 48 turned towards the motor and both cylindrical with the same curvatures are flush with each other. The base 48 protrudes radially outwards from the tubing 47.

Figure 2:
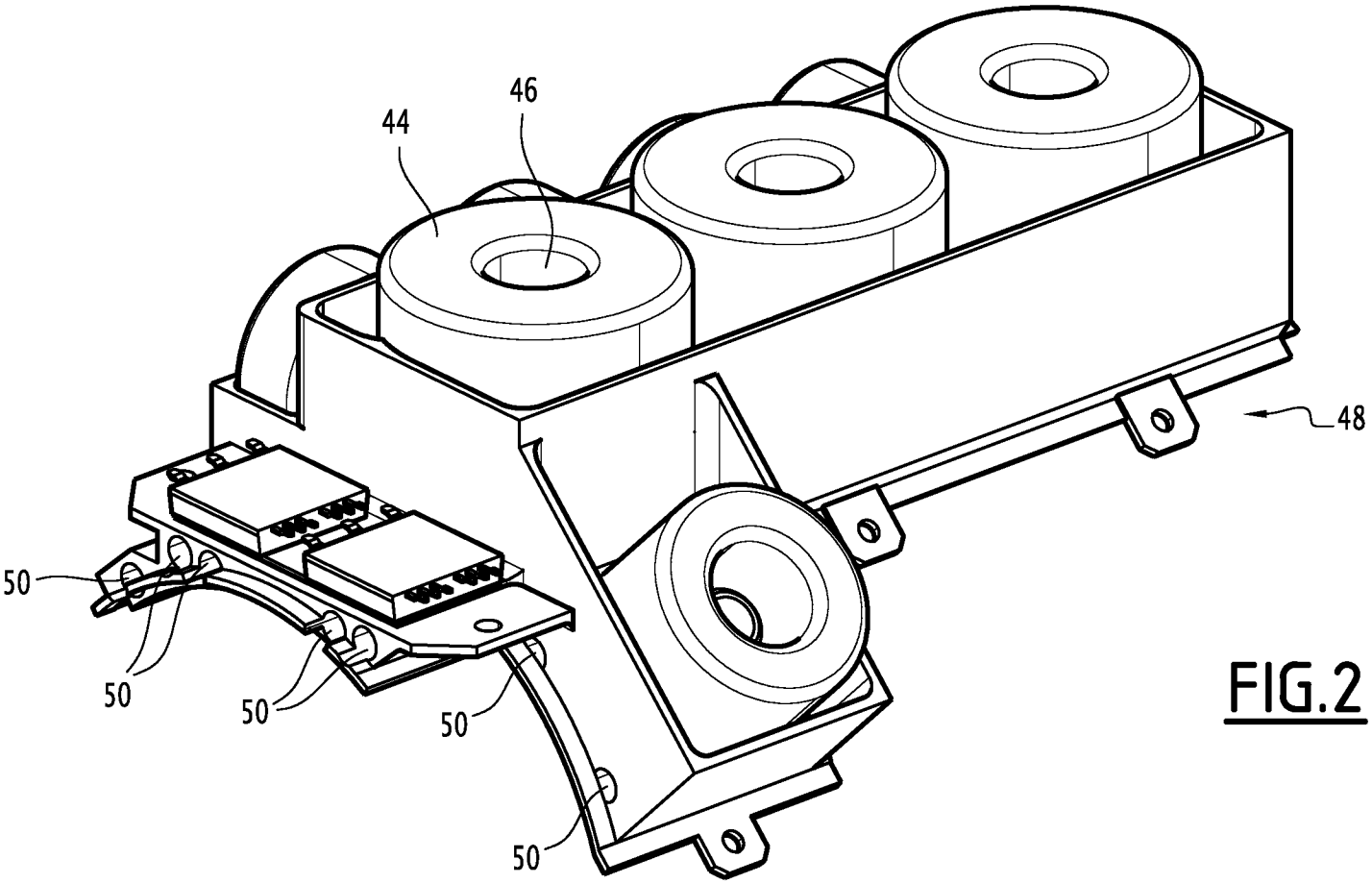
FIG. 2 is a three-quarter perspective view of the base of the fan bearing the electric circuit.

The base 48 is illustrated alone in FIG. 2.

Passages for cooling the components are provided through the ferrule 12 and notably through the base 48 in the relevant embodiment.

These passages include continuous conduits 50 circulating in the thickness of the ferrule. They are generally parallel to the X-X axis and open into the vein of air from an inlet tapping aperture 52 and one or several tapping apertures for reintroducing air 54, 56.

The inlet tapping aperture 52 is positioned upstream from the outlet tapping aperture 54, 56, considering the direction of circulation of the vein of air.

The conduits 50 include a main segment 60 extending longitudinally. This segment is rectilinear and extends beyond the end tapping apertures 52 and 56. This segment is obturated at each end with plugs 61 for example formed with a force-fitted polymeric stopper.

The tapping apertures 52, 54, 56 are formed with radial drill holes 62, 64, 66 opening into the main segment 60 and into the vein of air through the internal surface of the ferrule 12 through the corresponding tapping aperture.

Advantageously, the radial drill holes 62, 64, 68 which connect the main segment 60 to the internal surface of the ferrule 12 are made at positions depending on the position of the motor 22 and of the wheel 26. This gives the possibility of using a same base blank in fans of different structure by suitably piercing the tapping apertures. The Earth the same part may be used in several types of fan, by positioning on demand the radial drill holes at right angles to the desired inlet and outlet tapping apertures.

Preferably, according to an alternative embodiment not shown, the external ferrule and notably the base, is formed by extrusion in a die, the rectilinear segments 50 being formed by removable inserts ensuring a recess in the ferrule during its extrusion.

Preferably, the average diameter of each conduit is greater than 4 mm. it is preferably comprised between 4 and 8 mm and advantageously substantially equal to 6 mm.

The conduits 50 are dimensioned so that the velocity in the conduits is greater than 10 $m \cdot s^{-1}$, and preferably greater than 30 $m \cdot s^{-1}$.

Further, the dimensioning is such that less than 5% of the total flow from the fan circulates through the cooling conduits 50. Ideally, a flow of about 2% of the total flow circulates through the cooling conduits 50.

In the relevant example, the number of conduits is equal to 7. It is preferably comprised between 2 and 12.

It is conceivable that with such a layout, under the effect of the pressure difference between the downstream tapping aperture 52 and the upstream tapping aperture 54, 56, a cooling flow is established in the conduits 50. As this flow is channeled in conduits of relatively reduced size, the velocity of the cooling flow is relatively high, thereby promoting good removal of the heat produced by the electronic components 44 in thermal contact with the ferrule 12. Further, as the conduits 50 are continuous, the cooling flow does not circulate directly in contact with the components, thereby avoiding their degradation by possible contaminants which may be contained in the gas flow set into motion by the fan.

The invention claimed is:

1. A fan including:

an external ferrule, an internal surface of the ferrule delimiting a vein of air, a wheel provided with blades rotatably mounted in the external ferrule for setting into motion the vein of air, a motor for driving the wheel, an electric circuit including electronic circuit components for controlling and powering the motor, said electric circuit including cooling means for cooling the electronic circuit components by circulating air taken from the vein of air, wherein, said cooling means include a downstream air intake tapping aperture and an upstream tapping aperture for reintroducing air formed through the internal surface of the external ferrule, and at least one continuous cooling conduit connecting the upstream and downstream tapping apertures isolating the electronic circuit components of the electric circuit from the air circulating in the cooling conduit.

2. The fan according to claim 1, wherein said or each of the at least one continuous cooling conduit extends in the thickness of the external ferrule and the electronic circuit components are in thermal contact with the external surface of the external ferrule.

3. The fan according to claim 2, wherein the external ferrule is generally cylindrical and each of the at least one continuous cooling conduit generally extends along a generatrix of the external ferrule.

4. The fan according to claim 2, wherein each of the at least one continuous cooling conduit includes a main segment extending longitudinally in the thickness of the external ferrule from the upstream tapping aperture to the downstream tapping aperture, this main segment being plugged at each end, and each of the at least one continuous cooling conduit includes two generally radial drill holes connecting the upstream tapping aperture and the downstream tapping aperture of the main segment.

5. The fan according to claim 1, wherein the current diameter of said or each of the at least one continuous cooling conduit is comprised between 4 and 8 mm.

6. The fan according to claim 1, wherein said or each of the at least one continuous cooling conduit is able to take up 0.5% to 5% of a total flow rate of the fan.

7. The fan according to claim 1, wherein said or each of the at least one continuous cooling conduit is dimensioned so that a circulation rate of the cooling flow is at least equal to 10 m·s-1.

8. The fan according to claim 1, further comprising an inlet of the fan to connected to an outlet of the fan, wherein the vein of air circulates from the inlet of the fan to as far as the outlet of the fan.

9. The fan according to claim 1, wherein said downstream air intake tapping aperture is formed through the internal surface of the external ferrule.

10. The fan according to claim 1, wherein said or each of the at least one continuous cooling conduit is dimensioned so that a circulation rate of the cooling flow is at least equal to 30 m·s-1.

11. The fan according to claim 1, comprising plural of said downstream air intake tapping aperture and each downstream air intake tapping aperture is formed through the internal surface of the external ferrule.

* * * * *